US006193114B1

(12) United States Patent
Hopkins

(10) Patent No.: US 6,193,114 B1
(45) Date of Patent: Feb. 27, 2001

(54) PERSONALIZED HYGIENIC TOOTHPASTE DISPENSER AND TOOTHPASTE CONTAINER HOLDER

(76) Inventor: Michael J. Hopkins, 3053 Lemon St., Dubuque, IA (US) 52001

( * ) Notice: Subject to any disclaimer, the term of this patent is extended or adjusted under 35 U.S.C. 154(b) by 0 days.

(21) Appl. No.: 09/373,686

(22) Filed: Aug. 13, 1999

(51) Int. Cl.[7] ..... B65D 88/54; G01F 11/06; G01F 11/30; G01F 11/36; G01F 11/42

(52) U.S. Cl. ..... 222/330; 222/92; 222/481; 222/482; 222/485; 222/547; 239/279; 239/565

(58) Field of Search ..... 222/92, 330, 481, 222/482, 485, 547; 239/279, 565

(56) References Cited

U.S. PATENT DOCUMENTS

| | | | | |
|---|---|---|---|---|
| 3,591,053 | | 7/1971 | Thomas | 222/92 |
| 3,613,698 | * | 10/1971 | Fox | 132/84 |
| 4,651,904 | | 3/1987 | Schuckmann | 222/383 |
| 5,505,337 | | 4/1996 | Littman | 222/92 |
| 5,577,537 | | 11/1996 | Wells | 141/18 |
| 5,577,640 | | 11/1996 | Albini | 222/378 |
| 5,660,216 | | 8/1997 | Wells | 141/369 |

* cited by examiner

*Primary Examiner*—Timothy L. Maust

(57) ABSTRACT

A hygienic toothpaste dispenser comprises a main body member having a plurality of tubular spouts (27, 28, and 29), from which an individual can dispense toothpaste from his or her own personally assigned tubular spout permanently marked by indicia (30), thereby providing a sanitary delivery system. This dispenser has a main body with a base (23) for connection to a toothpaste container (20), either directly or via an adapter (FIG. 10), and tubular spouts with caps (31) for delivery of the paste. Additional dispenser embodiments (FIGS. 8A, 8B, and 9) are shown. Also additional adapter embodiments (FIGS. 11A, 11B, 11C, 12, 13, 14, 15, 16, and 17) show various means of connection between various types of toothpaste container tubular spouts and the various types of bases of the main body of the dispenser. Several dispensers may be connected together (FIG. 4), providing almost an unlimited number of assignable tubular spouts, limited only by a reasonable length and a reasonable width. The dispenser's structure provides a notch or notch and groove (38) to hang the dispenser and toothpaste container. This dispenser incorporates a removable one-way valve (33) and (34) that can automatically eliminate pull-back contamination. The dispenser and toothpaste container can be manufactured, with or without a check-valve, as one unit (FIG. 18).

40 Claims, 10 Drawing Sheets

PERSONALIZED HYGIENIC TOOTHPASTE DISPENSER AND TOOTHPASTE CONTAINER HOLDER

BACKGROUND

1. Field of Invention

This invention pertains to a dispenser, specifically for dispensing paste-like material, such as toothpaste, in a hygienic manner to a plurality of users.

2. Description of Prior-art

It has long been recognized that multiple users contaminate the tip of a toothpaste tube. Now with thinner brands of toothpaste, the interior of the toothpaste container becomes exposed to germs when the toothpaste is drawn back inside the tube. The shape of most toothpaste containers is that of a round cylinder. The toothpaste container is often laid on or about the edge of the sink while the user is brushing his or her teeth. The laying of the container in this damp area increases its exposure to germs. Because of the shape, the container often slides off on the floor or into the sink, exposing itself to more germs.

There are many different types of dispensers for dispensing a substance through a plurality of tubular spouts.

U.S. Pat. No. 3,591,053 to Thomas (1971) shows a sanitary toothpaste dispenser that is threadably attached to a toothpaste tube. It dispenses through a plurality of nozzles or tubular spouts, spaced apart and provided with caps. Toothpaste can be selectively dispensed from each of the tubular spouts onto a toothbrush by removing an individual cap, squeezing the tube, and allowing the paste to flow out of the designated tube. Certain tubular spouts are made of different lengths so as to be able to assign a certain tubular spout to a specific individual. In addition, the various caps may be of different colors. This dispenser has five tubular spouts but only three different lengths. This causes confusion when the caps are removed. The caps may be identified by color but there is no way to associate caps with their respective spouts. It does not appear to be able to connect two or more dispensers together or expand to handle a larger number than it is designed. The paste can also return into the container after use, causing cross contamination between users.

U.S. Pat. No. 5,505,337 to Littman (1996) shows a hygienic toothpaste dispenser for selectively distributing toothpaste onto a toothbrush from one of a plurality of tubular spouts oriented to form a stand for a toothpaste container shaped as a cylinder, the tubular spouts being capped with snap-type covers. The tubular spouts have peelable indicia to identify with respective users. The toothpaste dispenser serves as a stand in the shape of a tripod with legs that curve outwardly and upwardly. The stand holds the toothpaste container vertically and uses gravity to dispense toothpaste from the tubular spout. This stand can have any number of tubular spouts or legs and it must rest on a flat surface. The base of the stand is small compared to overall height of the dispenser and tube. This combined unit of dispenser and tube is top heavy and easy to topple over, especially with the squeezing and changing of the shape and weight. The size of this dispenser is too big and takes up too much space. The peelable discs could come off. This dispenser is not expandable. The curved tubular spouts are not conducive to connecting dispensers together. This dispenser has curved tubular spouts and the interior of the dispenser is subdivided into chambers (determined by the number of tubular spouts) by a plurality of vertically extending divider plates whose inner ends intersect at the center of the cylinder. So to increase the number of tubular spouts the cylinder would have to be subdivided into smaller and smaller chambers. This complicates its ability to too increase the number of tubular spouts. It does not have a way to prevent the paste from returning to the tube. If a cap is left off, gravity may cause non-viscous toothpaste to ooze out of the tubular spout and down the side.

Neither of these show a dispenser that is expandable for a large number of users. A manufacturer would have to make the dispensers with various numbers of tubular spouts and carry large supplies of inventory of these various sizes. For example, a manufacturer of either of these devices would have to manufacture dispensers with many combinations of numbers of tubular spouts to satisfy the various sizes of the family unit, or the customer would have to purchase several of these dispensers to satisfy the size of his or her family. Additionally, he or she would need to purchase a container of toothpaste for each of these dispensers.

Several dispensers have been devised for delivering a product or products through multiple chambers. Thomas' and Littman's previously mentioned inventions, are the only dispensers that dispense toothpaste through multiple chambers and thus are the closest related prior-art. Recent developments in the composition of some toothpaste have created a paste with a thinner texture. This thinner texture has created a problem with squeeseable toothpaste tubes. The thinner toothpaste, once squeezed out of the container, tends to pull back into the tube. This is caused by the container trying to return to its original shape. It creates a suction that is greater than the resistance of the paste. This suction pulls the thinner toothpaste back into the container, causing contamination to occur. This has not been a problem with thicker, more viscous toothpaste. This problem varies from toothpaste to toothpaste.

Neither of these previously mentioned inventions have a means to control the flow of paste from returning to the tube or oozing out of the dispenser.

U.S. Pat. No. 5,577,537 (1996) and U.S. Pat. No. 5,660,216 (1997) to Wells both show an apparatus for adapting toothpaste dispensers for use by physically challenged individuals. They show dispenser holders, adaptive handles, and toothbrush guides. Several objects of these devices is to provide a system for the physically challenged individuals to independently dispense toothpaste from a pump-style toothpaste dispenser, to provide a holder base that rests on a flat horizontal surface and holds the dispenser perpendicular to the flat surface, and to provide toothbrush guides to hold the brush in proper position to receive toothpaste as it is dispensed from the dispenser. It can be provided with support arms and an extension handle that when depressed also depresses the pump actuator of pump style toothpaste dispensers. It comprises a nozzle closing plate that seals the dispenser when not in use.

Both dispense out of one nozzle. Neither provide a hygienic environment to dispense the toothpaste. Multiple users use the same toothbrush guides while receiving toothpaste, exposing the guides and the toothbrush to contaminates. Neither are expandable in any fashion. Both must sit on a flat surface. Both appear to be too big to be stored away in the medicine cabinet. Both are pump-style toothpaste dispensers/containers.

All of the above dispensers attach to toothpaste containers. Only Wells shows a dispenser that attaches and has a closing valve. This dispenser holds the container perpendicular to the surface and it appears the purpose of the closing valve is to prevent gravity from causing the paste to flow out of the container and not to prevent the paste from returning to the container. It lacks hygienic features because it dispenses through one common discharge outlet.

U.S. Pat. No. 5,577,640 to Albini (1996) shows a creamy substance dispenser that includes a main body defining a metering chamber communicating with a creamy substance container. A metering device is a sealedly slidable piston with a hollow stem and biased by a spring. This metering device perfectly seals the discharge hole to isolate the creamy substance present in the dispenser from the air. Also, this metering device is a one-way valve preventing the paste from returning to the container and contaminating the contents . This device is designed as a dispenser/container with the elements of a piston and a spring acting to seal the discharge hole from the air. It dispenses through one common discharge hole. It is not expandable. It is discarded when the contents are empty and thus is not reusable or removable. The dispenser/container is manufactured with the metering device or one-way valve installed. The user can not remove or install the one-way valve.

U.S. Pat. No. 4,651,904 to Schuckmann in (1987) shows a dispenser for pasty compositions, particularly a toothpaste dispenser, with a pump-like actuation for the portioned delivery of the contents from a nozzle outlet channel. It has a pump chamber the volume of which is decreasable against spring action by displacement of the actuator. The pump chamber is located between two valves with respect to a direction of flow of the contents. One of the valves communicates with the storage space and the other valve communicates with the nozzle outlet channel. It uses a coil spring and valve flaps in the actuation of the valves. This patent shows two valves that lie in a straight line with the one nozzle outlet channel. This dispenser does not discharge through multiple discharge outlet channels. It is not expandable. It is discarded when the contents are empty. It is not reusable or removable. The dispenser/container is manufactured with the metering device or one-way valve installed. The user can not remove or install the one-way valve.

OBJECTS AND ADVANTAGES

Accordingly one of the primary objects of the present invention is to provide an improved dispenser for toothpaste or other viscous substances. Other objects are to provide a sanitary means of dispensing toothpaste to several users, to provide a sanitary delivery through a simple basic structure that has many features, to provide a dispenser with simplicity of design, flexibility of use, and multiple functions to enhance its value. The following features are present:

(a) a toothpaste dispenser that is hygienic in nature;

(b) a simple dispenser with few tubular spouts that are expandable to several tubular spouts;

(c) a dispenser that can include a one-way check-valve that can prevent contamination of the contents of the toothpaste container by automatically preventing the pull-back of toothpaste into the container;

(d) a dispenser with tubular spouts and caps that can be identified by respective users;

(e) a dispenser which can be hung conveniently;

(f) a dispenser which is removable, washable, and reusable;

(g) a dispenser that has an interior free of any dividers;

(h) a dispenser that has a simple basic design which is economical to manufacture, economical to use, and has an overall small footprint;

(i) a dispenser that can be of various sizes, shapes and materials;

(j) a dispenser and toothpaste container that can be manufactured as one unit; and (k) an adapter that is used to connect the dispenser to the various toothpaste containers and can include a one-way check-valve.

Further objects and advantages will become apparent from a consideration of the ensuing description and accompanying drawings.

REFERENCE NUMERALS IN DRAWINGS

Figure 1A:
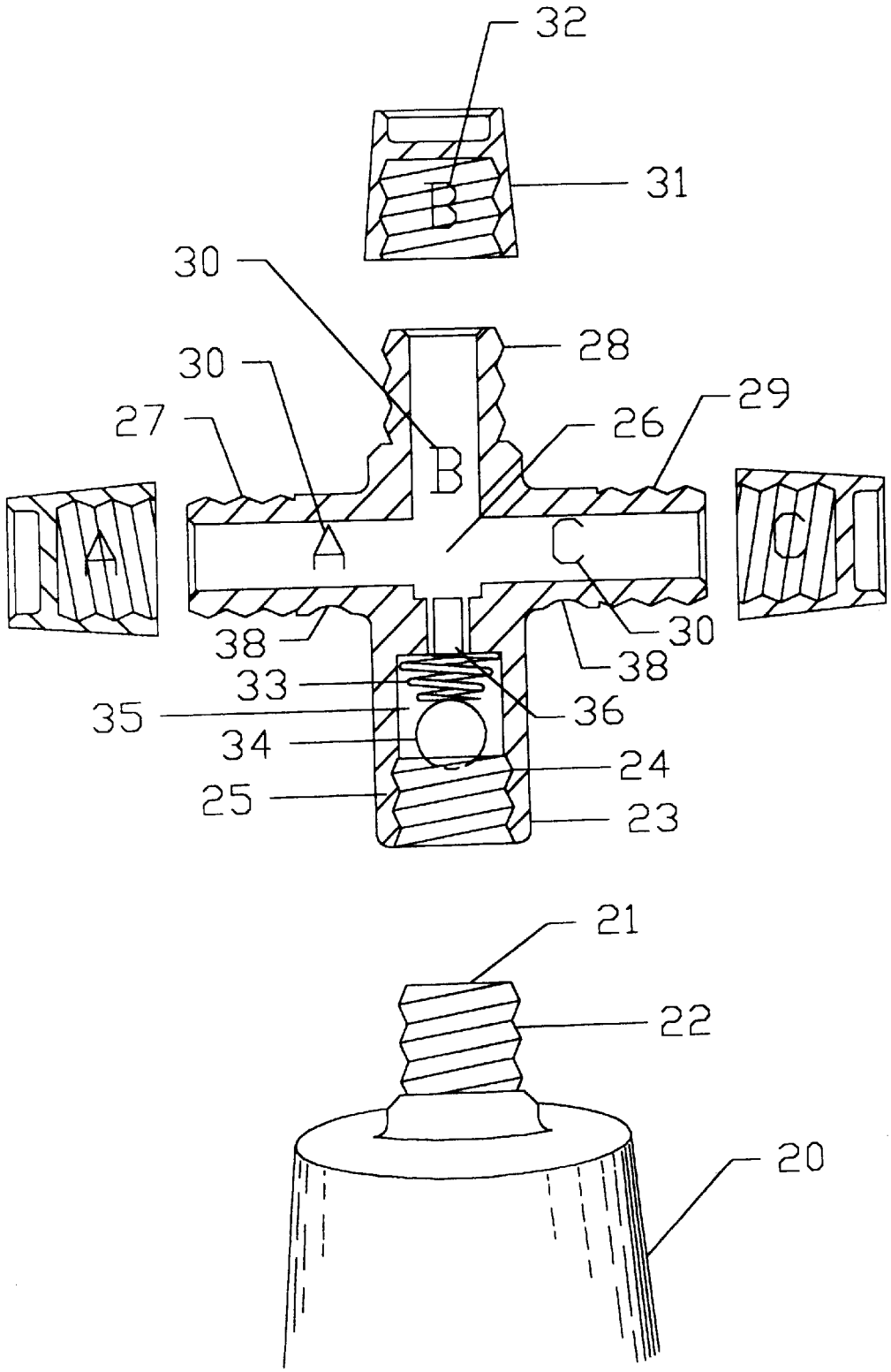
FIG. 1A shows a front sectional view of the preferred embodiment of a dispenser according to the invention with three tubular spouts, prior-art caps and prior-art tube of toothpaste.
Figure 1B:
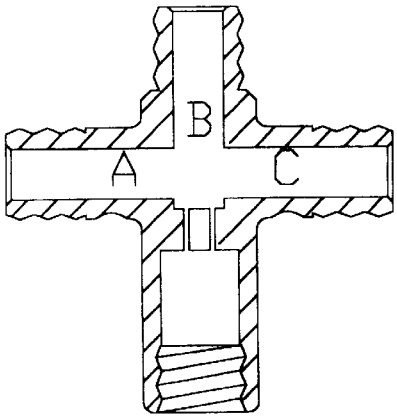
FIG. 1B shows a front sectional view of the embodiment of FIG. 1A without the check-valve, without the prior-art caps, and without the prior-art tube of toothpaste.
Figure 1C:
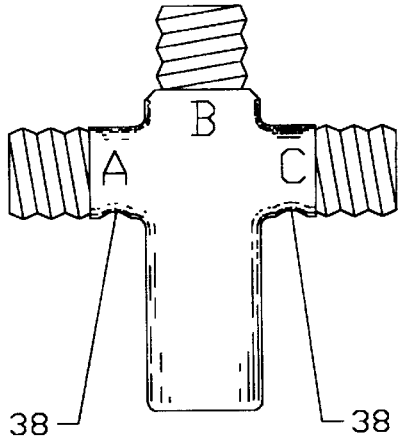
FIG. 1C shows an exterior view of the embodiment of FIG. 1A without the prior-art caps and without the prior-art tube of toothpaste.

20 Toothpaste Container
21 Opening in Tip
22 Male Threaded Tubular Spout of Toothpaste Container
23 Base of Dispenser
24 Female Threads of Base of Dispenser
25 Dispenser
26 Hollow Passageway
27 Male Threaded Tubular Spout Container
28 Male Threaded Tubular Spout
29 Male Threaded Tubular Spout
30 Permanently Marked Indicia on Tubular Spouts
31 Caps
32 Permanently Marked Indicia on Caps
33 Coil Spring
34 Ball
35 Chamber Area
36 Internal Splined Ridges and Grooves in Dispenserin Dispenser
37 Push Rod
38 External Groove for Hanging
39 Male Threads of Adapter
40 Female Threads of Adapter Internal Splined Ridges and Grooves in Adapter
41 Male Threads of Dispenser
42 Internal Splined Ridges and Grooves in Adapter
43 Female Threads of Toothpaste
44 External Snap Ring of Adapter
45 Internal Snap Groove Inside of Dispenser
46 Internal Groove Inside of Adapter
47 External Flange on Base of Dispenser
48 External Flange on base of Adapter
49 Internal Groove on Tubular Spout of Toothpaste Container
50 External Groove on Adapter
51 Internal Flange in Base of Dispenser
52 Internal Flange in Tubular Spout of Toothpaste Container
53 Not used
54 Internal Snap Flange in Adapter
55 External Snap Groove in Base of Dispenser
56 Internal Snap Groove in Adapter
57 External Snap Flange on Tubular Spout of Toothpaste Container
58 External Groove on Tubular Spout of Toothpaste Container
59 Internal Flange in Adapter
70 Unit Embodiment as shown in FIG. 1C
71 Unit Embodiment as shown in FIG. 1C

SUMMARY

In accordance with the present invention, an expandable hygienic toothpaste dispenser dispenses toothpaste through multiple personalized tubular spouts. A check-valve can be installed in the dispenser to prevent the toothpaste from returning and contaminating the contents of the toothpaste container. Notches and grooves are provided on the tubular spouts formed at an angle to the main body to hang the dispenser and toothpaste tube.

Figure 1D:
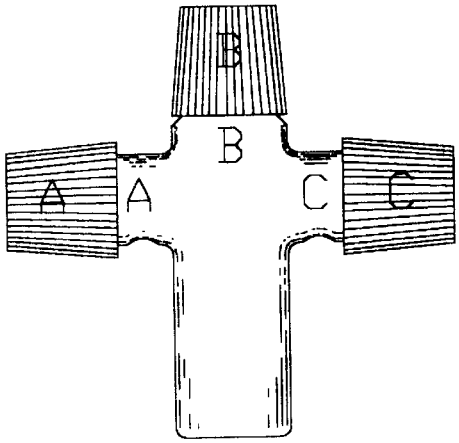
FIG. 1D shows an exterior view of the embodiment of FIG. 1A with caps installed and without the prior-art tube of toothpaste.
Figure 2:
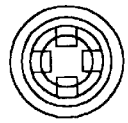
FIG. 2 shows a plan view looking down on just a top tubular spout of the embodiment of FIG. 1A.
Figure 3:
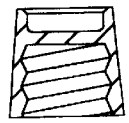
FIG. 3 shows a sectional view of the prior-art cap that is illustrated in FIG. 1A.

Description—FIGS. 1–3 (Front Sectional View)

A front sectional view of a typical embodiment of the present invention with three tubular spouts and all its components is shown in FIG. 1A. FIG. 1B shows the same view as FIG. 1A without all the components. FIG. 1C shows an exterior view of FIG. 1B. FIG. 1D shows the same exterior view of FIG. 1C with caps installed on the spouts. FIG. 2 shows a plan view of just the top tubular spout with the splined ridges and grooves extending out into the barrel chamber of the tubular spout retaining a ball. FIG. 3 shows a front sectional view of a female threaded cap.

Figure 4:
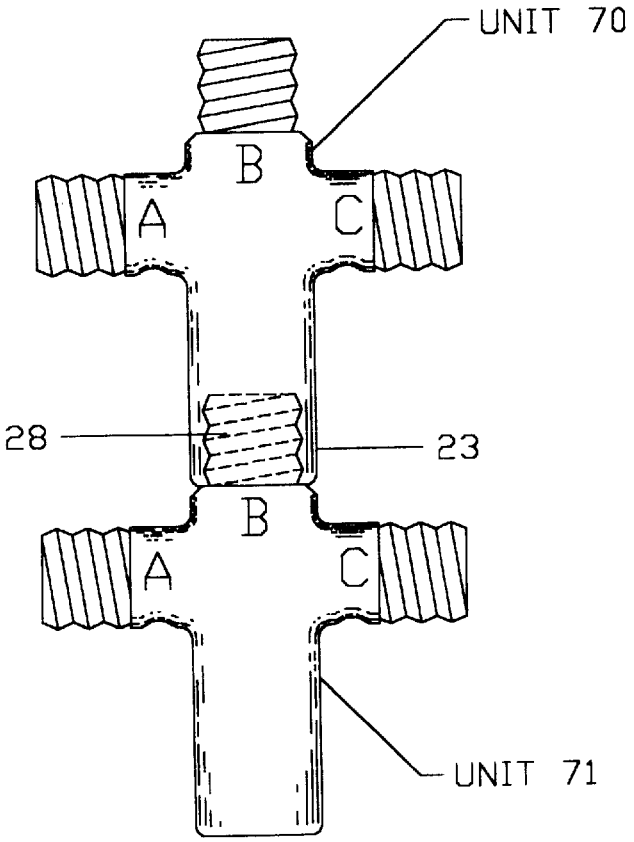
FIG. 4 shows an exterior view of two of the dispensers of FIG. 1C threaded together into one unit, creating a new embodiment.
Figure 10:
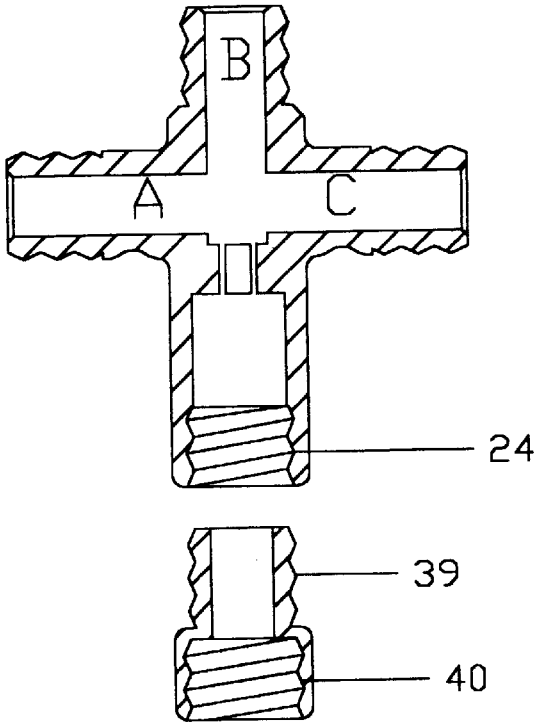
FIG. 10 shows a front sectional view of a preferred embodiment of an adapter with male threads on one end and female threads on the other end and the embodiment of my hygienic dispenser illustrated in FIG. 1B.

FIG. 1A shows a container of toothpaste 20 has an opening 21 of male threaded tubular spout 22 which mates with a base end 23 of my hygienic dispenser. Female threads 24 of the bottom or base arm of my dispenser mate with male threaded tubular spout 22. Dispenser 25 can be made of any suitable material, such as plastic. A hollow passageway 26 connects to a plurality of tubular spouts 27, 28, and 29 that have exterior male threads. These male threads can be the same size as the male threads of the toothpaste container that fits the base of the dispenser or they can be of a different size. Base end 23 with its internal female threads 24 will not only accept tubular spout 22 of a toothpaste container, but can accept male threaded tubular spout 27, 28, or 29 of another similar dispenser, as shown in FIG. 4 and/or an adapter as shown in FIG. 10. Each tubular spout is permanently marked with indicia 30, such as a letter, color coding, or both. A cap 31 mates with any of tubular spouts 27, 28, or 29. An indicium 32 on cap 31 is similar to indicium 30 on tubular spout 28 and so on.

A coil spring 33 and a ball 34 are installable by the user into a chamber area 35 adjacent to female threads 24 in base end 23 of the dispenser. The dispenser is then threaded onto the tip of the toothpaste container. The coil spring applies pressure to the ball and pushes it against opening 21 of the container, closing the flow and preventing the return flow of toothpaste back into the container. Internal splined support ridges and grooves 36 are located at the exit end of chamber 35. When the paste is pushed against the ball, the ball pushes against the spring, compressing it. The spring is supported and retained by the end of ridges. The paste then flows around the ball into the spring and through the grooves between the ridges and out the tubular spout. If the ball completely compresses the spring the paste will still pass through the grooves because the ball doesn't seal off against the uneven end of the ridged and the grooved passageway. The user is required to exert a little more pressure to compress the spring to allow the paste to flow out of the tube. This additional pressure compared with squeezing just a tube of toothpaste by itself without a hygienic dispenser is minimal.

A push rod 37 or any other similar device is used to remove the ball and spring from the dispenser. External grooves 38 on tubular spouts formed at an angle with the main body of the dispenser are provided for hanging the dispenser.

Operation—FIGS. 1, 2

The way in which the hygienic dispenser is used starts with an examination of the components. First if the dispenser has the spring and ball installed then the user removes the cap from the toothpaste tube and screws the dispenser onto the tip of the toothpaste tube. If the spring and ball are not installed, then the user turns the dispenser so that the base faces up and inserts the spring and then the ball into the base of the dispenser. Then the user removes the cap from the toothpaste tube, turns the tube so that the tip is facing down, and screws the tip of the tube into the base of the dispenser. Inverting the dispenser with the base up helps to hold the spring and ball in place while one is connecting the dispenser and tube together. The caps are then removed from the dispenser and toothpaste is pushed from the container through the dispenser. When toothpaste fills the passageways in the tubular spouts, the caps are then placed on their matching spouts. Users are assigned to the individual tubular spouts and matching cap. The dispenser is now ready to use.

A user then removes his or her assigned cap from the matching tubular spout and pushes toothpaste out of his or her personal spout as if the user was dispensing toothpaste from just the toothpaste container itself. However now the paste is being delivered in a hygienic manner.

When the user has finished dispensing paste, he or she returns the matching cap to the matching tubular spout to prevent the paste at the end of the opening from being exposed to the air and contaminants. If the user failed to do this, the following user would notice the cap was missing and would replace it on the matching spout before he or she used the dispenser. The cap would need to be returned to its matching spout by the primary user or the secondary user because when a secondary user tried to use his or her assigned spout paste would try to flow from both spouts at the same time.

Occasionally the user might want to clean the dispenser and caps. The ball and spring can be removed so that the dispenser and parts can be washed inside and out. If the user purchased a viscous brand of toothpaste and determined the viscosity was such that the paste did not pull back into the container then he or she could remove the check-valve altogether. The user can choose to eliminate the function of the check-valve by removing the ball and spring from the dispenser and the dispenser will retain its other functions. The user could choose to operate the check-valve by the use of the ball alone without the urging of the spring. The viscosity of the paste as it tried to return to the container would pull the ball against the opening in the toothpaste container closing the return flow of the paste to the container. Likewise, gravity would assist in holding the ball against the opening to the container when the dispenser is hung up. The use of the spring and ball would give a definite closure each and every time pressure on the paste is relaxed and would eliminate any uncertainty of closing by not using the ball by itself without the urging of the spring.

To remove the ball and spring, the user first removes the toothpaste container from the dispenser. The user then removes the cap from the tubular spout opposite of the base end of the dispenser, inserts the push rod or other similar device such as a pipe cleaner into the tubular spout and pushes the ball and spring out of the base.

Operation—FIG. 3 (Front Sectional View)

To install a cap the user locates a tubular spout with matching indicium. The user then threads the cap on the spout by twisting the cap on. If the cap had other means of connecting, such as a snap ring, then the user would push the cap on instead of twisting. The opposite application is applied to remove the cap. It is either twisted in the opposite direction to remove or it is pulled to remove.

Description—FIG. 4

FIG. 4 shows a front exterior view of two embodiments illustrated in FIG. 1C joined together into one dispenser consisting of five tubular spouts. Base 23 of unit 70 is threaded onto the threads 28 of tubular spout B of unit 71.

Operation—FIG. 4 (Front Exterior View)

To combine two dispensers as illustrated in FIG. 1C into one embodiment, one screws the base 23 of unit 70 onto the threads 28 of tubular spout B of unit 71. This joining of these two dispensers together makes one dispenser with five tubular spouts, as pictured in FIG. 4. This new embodiment can now be operated like the embodiment in FIG. 1. To separate this dispenser, one reverses the process by unscrewing the dispenser where the two are joined together.

Figure 5:
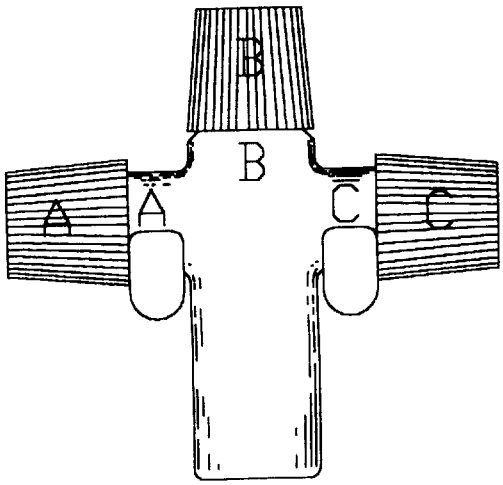
FIG. 5 shows a front exterior view of the embodiment of FIG. 1A resting on prior-art hanging device shown in FIGS. 7A–7C.
Figure 6A:
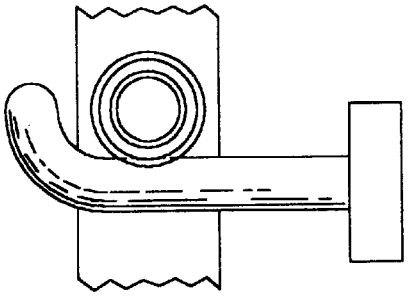
FIG. 6A and FIG. 7A show a side view of the embodiment of FIG. 1A hanging on prior-art hanging devices.

Description—FIGS. 5 (Front View), 6A, 6B, 7A, 7B (Side View) and 6C, 7C (Plan View)

Figure 7A:
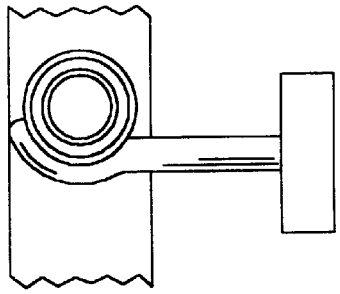
Figure 6B:
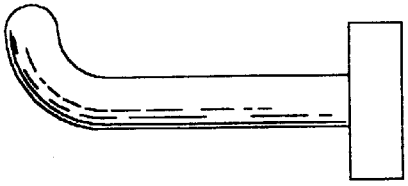
FIG. 6B and FIG. 7B are side views of prior-art hanging devices.
Figure 7B:
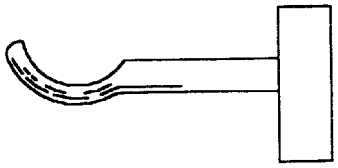
Figure 6C:
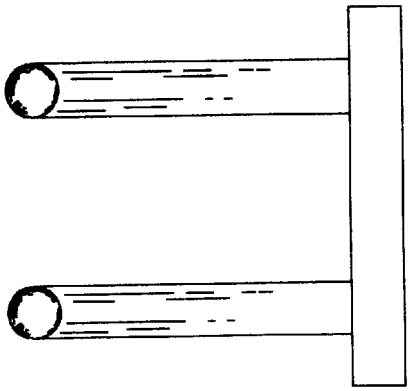
FIG. 6C and FIG. 7C are plan views of prior-art hanging devices.
Figure 7C:
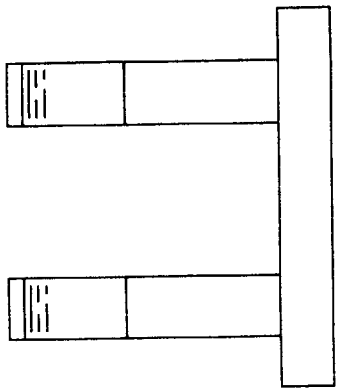

FIG. 5 shows a front exterior view of the embodiment found in FIG. 1D at rest on hooks illustrated in FIGS. 7A–7C. These hooks or hanging devices are assumed to be prior art. The hooks hold the dispenser by notches on the tubular spouts. The notches for holding are located on the tubular spouts connected to the main body at an angle. The notch is that area or space on the tubular spout created by the edge of the cap and the edge or side of the main body and the tubular spout between these two edges.

FIGS. 6A–6C and FIGS. 7A–77A–7C show examples of hook devices for holding the embodiment shown in FIG. 1C.

Operation—FIGS. 5, 6A–6C and 7A–7C

To hang the embodiment on a hook as shown in these views, one simply slides the main body between the hook arms so that the notches and the grooves on the tubular spouts rest or cradle on the hook arms. The base of the dispenser and toothpaste container, if attached, should hang between and below the hook arms.

Figure 8A:
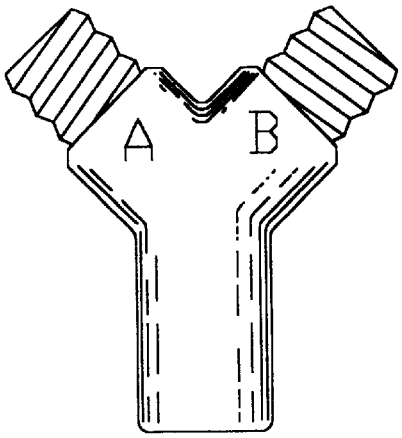
FIG. 8A shows a front view of an additional embodiment having two tubular spouts in a "Y" configuration.
Figure 8B:
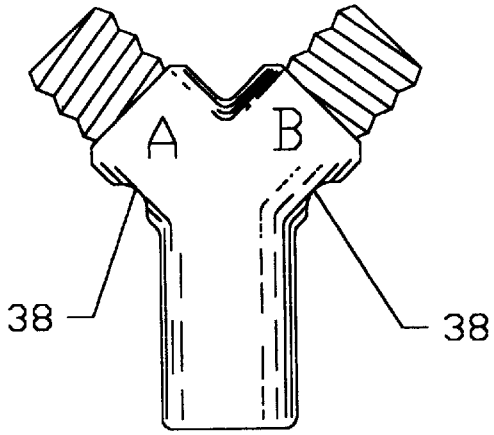
FIG. 8B shows a front view of an additional embodiment having two tubular spouts in a "Y" configuration, with each spout having a groove for hanging.
Figure 9:
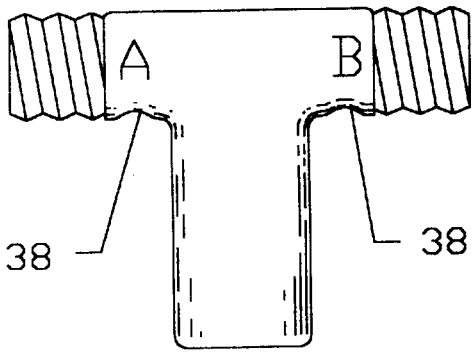
FIG. 9 shows a front view of an additional embodiment having two tubular spouts in a "T" configuration, with each spout having a groove for hanging.

Description—FIGS. 8A, 8B, and 9 (Front Exterior View)

FIGS. 8A, 8B, and 9 show exterior views of three embodiments with each having two tubular spouts for dispensing. In FIGS. 8A and 8B, the dispensers are in the shape of a "Y". In FIG. 8B, a groove 38 on each tubular spout assists in holding the dispenser. In FIG. 9 the dispenser is in the shape of a "T" and has a groove 38 on each tubular spout to assist in holding the dispenser.

Operation—FIGS. 8A, 8B, and 9 (Front Exterior View)

The operation of these embodiments is much the same as in FIG. 1, except these embodiments have only two tubular spouts which makes the removal of the ball and spring a little more complicated. A flexible pipe cleaner is inserted into one of the spouts of FIG. 8A or 8B and used to push the spring and ball out of the base. It becomes a little more complicated to remove the spring and ball from the embodiment of FIG. 9. In this embodiment one washes the paste away from the ball and spring by holding the base under a stream of water then shakes the ball and spring out of the base. The manner of hanging these embodiments with two tubular spouts is much the same as hanging an embodiment with three tubular spouts described in the operation for FIG. 5. The manner of joining these embodiments with two tubular spouts is much the same as explained in the operation of FIG. 4 except the rate of expansion is slower than joining two of the preferred embodiments of FIG. 1C. This is the reason three tubular spouts is preferred over two tubular spouts.

Description—FIGS. 10, 11A, 11B, and 11C (Front Sectional View)

FIG. 10 shows a cross sectional view of an adapter and a dispenser illustrated in FIG. 1B. The adapter has male threads 39 on one-end and female threads 40 on the other. Male threads 39 of the adapter fit into the female threads 24 at the base of the dispenser.

Figure 11B:
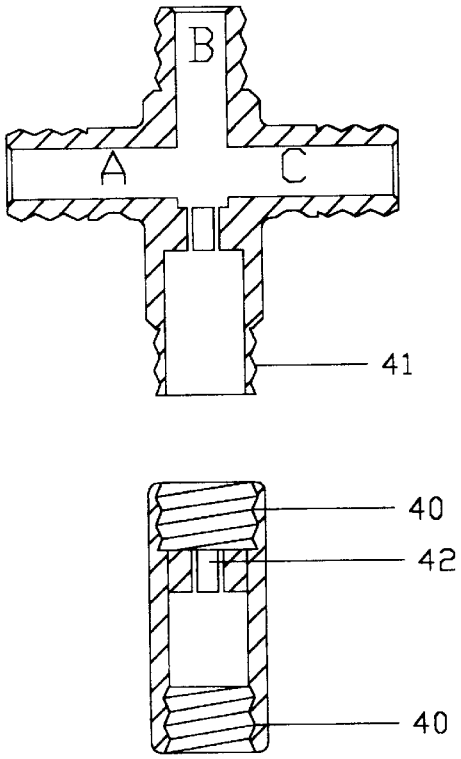
FIG. 11B shows a front sectional view of an additional embodiment of an adapter with female threads on both ends and internal ridges and grooves at one end adjacent to the internal threads and an additional embodiment of my hygienic dispenser with a male threaded base.
Figure 11C:
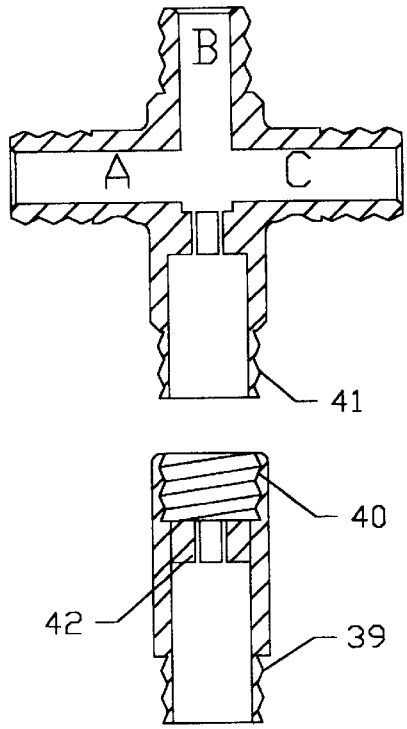
FIG. 11C shows a front sectional view of an additional embodiment of an adapter with female threads on one end and male threads on the other end and internal grooves and ridges at one end adjacent to the internal threads. Also, an additional embodiment of my hygienic dispenser with a male threaded base and an additional embodiment of a toothpaste container with a female threaded tubular spout.
Figure 11C:
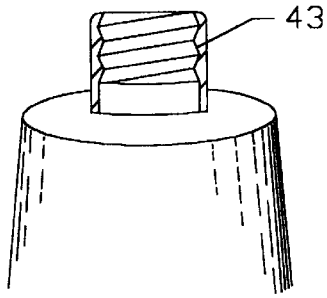
Figure 11A:
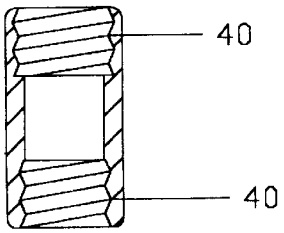
FIG. 11A shows a front sectional view of an additional embodiment of an adapter with female threads on both ends.

FIGS. 11A and 11B show cross sectional views of two adapters. Both adapters have female threads 40 on each end of the adapter. FIG. 11B has internal splined ridges and grooves 42 at one-end of the adapter located next to female threads 40. Splined ridges and grooves 42 in this adapter allow the user to create a check-valve in the adapter by installing spring 33 and ball 34 shown in FIG. 1A. FIG. 11B also shows a dispenser similar to FIG. 1B, except that the base of the dispenser has male threads 41 instead of female threads.

FIG. 11C shows a cross sectional view of an adapter. The adapter has female threads 40 on one-end and male threads 39 on the other. FIG. 11C has internal splined ridges and grooves 42 at one-end of the adapter located next to female threads 40. Splined ridges and grooves 42 allow the user to create a check-valve in the adapter by installing spring 33 and ball 34 shown in FIG. 1A. FIG. 11C also shows a dispenser similar to FIG. 1B, except that the base of the dispenser has male threads 41 instead of female threads and will mate with female threads 40 of the adapter. FIG. 11C also shows a toothpaste container with female threads 43 that will mate with male threads 39 of the adapter.

Operation—FIGS. 10, 11A, 11B, 11C (Front Sectional View)

These adapters join the hygienic dispenser to the toothpaste container by threads. The manner in which this is done is as follows: the adapter is threaded to the dispenser and then the toothpaste container is threaded to the adapter. The operation of joining 11B and 11C is the same except that the female threaded end 40 of the adapter that has the splined ridges and grooves 42 connects to male threaded base 41 of the dispenser illustrated in FIG. 11B and FIG. 11C. Spring 33 and ball 34 shown in FIG. 1A can then be inserted into the other end of the adapter. The adapter is then threaded to the tubular spout of the toothpaste container.

Description—FIGS. 12, 13, 14, 15, 16, 17

Figure 12:
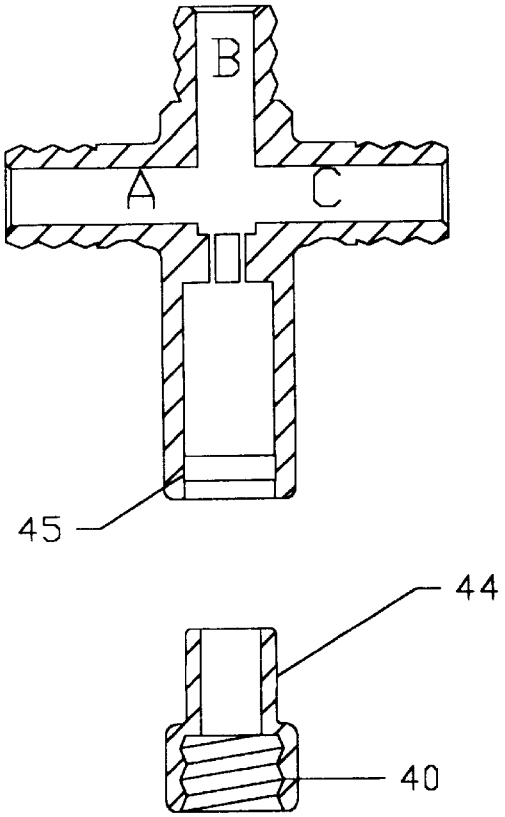
FIG. 12 shows a front sectional view of an additional embodiment of an adapter with female threads on one end and on the other end a small flange or snap ring on the exterior for connecting to an additional embodiment of my hygienic dispenser with a base with an internal groove for connecting instead of threads for connecting.

FIG. 12 shows how a snap ring or ridge 44 on the adapter connects to a snap groove 45 in the base of the dispenser. Also shown are female threads 40 of the adapter for connection to a toothpaste container not shown.

Figure 13:
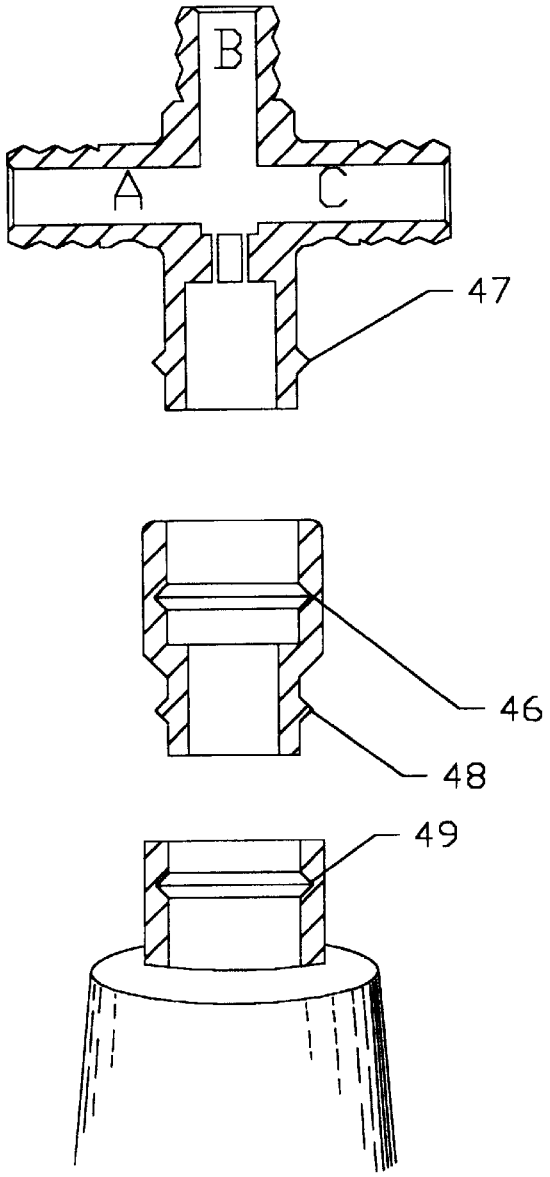
FIG. 13 shows a front sectional view of an additional embodiment of an adapter with an internal groove on one end for connecting to an additional embodiment of my hygienic dispenser with a base with an exterior flange for connecting instead of threads for connecting and on the other end of the adapter an exterior flange for connecting to a toothpaste container with a tubular spout with an internal groove for connecting.

FIG. 13 shows how a groove 46 in the adapter connects to an exterior flange 47 on the base of the dispenser. The other end of the adapter has an exterior flange 48 that mates with an interior groove 49 in the tubular spout of the toothpaste container.

Figure 14:
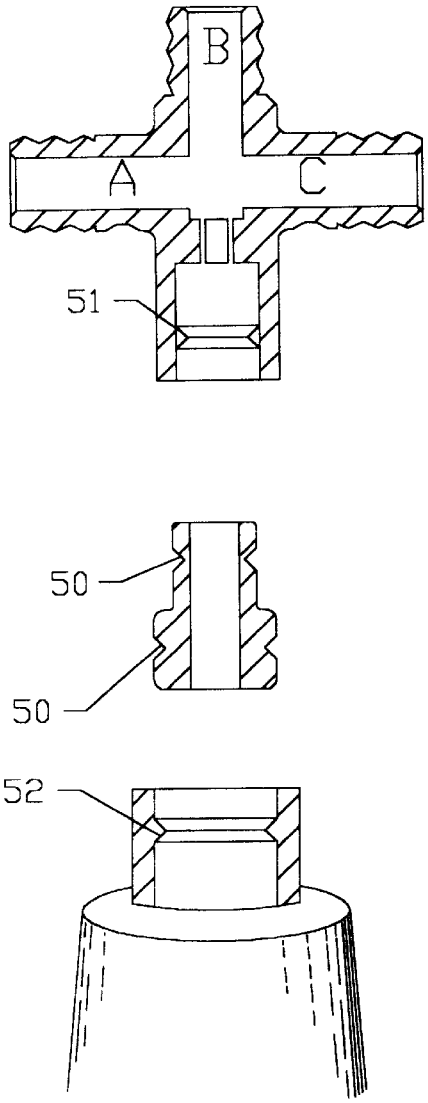
FIG. 14 shows a front sectional view of an additional embodiment of an adapter with an external groove on both ends for connecting to an additional embodiment of my hygienic dispenser with a base with an internal flange for connecting instead of threads for connecting and a toothpaste container with a tubular spout that has an internal flange for connection.

FIG. 14 shows a front sectional view of an embodiment of an adapter and a dispenser illustrated in FIG. 1B except the dispenser has an internal flange 51 instead of internal threads for connection. The adapter has external grooves 50 on both ends for connection. Also shown is a toothpaste container with a tubular spout that has an internal flange 52 for connecting to the adapter.

Figure 15:
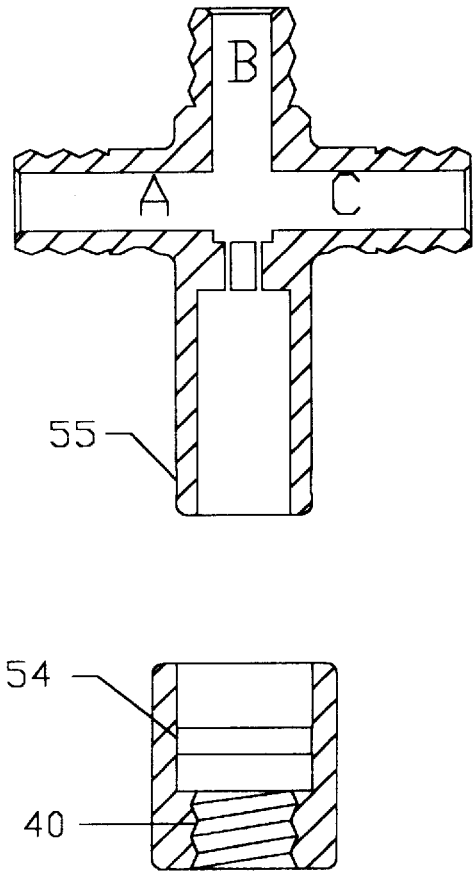
FIG. 15 shows a front sectional view of an additional embodiment of an adapter with female threads on one end for connecting to a toothpaste container not shown and on the other end an interior snap ring or ridge for connecting to an additional embodiment of my hygienic dispenser with an exterior snap groove for connecting instead of threads for connecting.

FIG. 15 shows how an internal snap ring or ridge 54 in the adapter connects to an external snap groove 55 on the base of the dispenser. Also shown are female threads 40 of the adapter for connection to a toothpaste container not shown.

Figure 16:
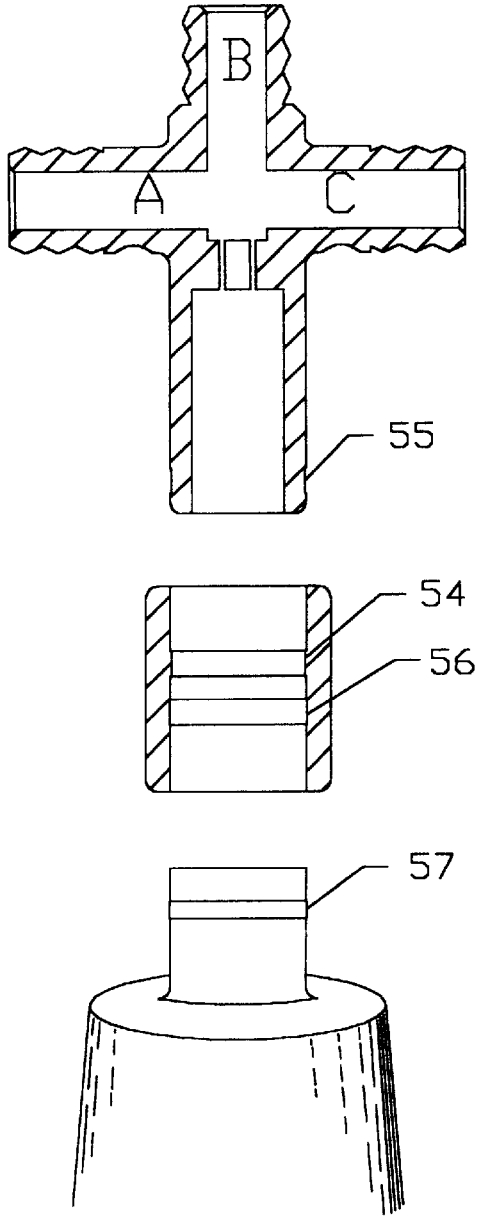
FIG. 16 shows a front sectional view of an additional embodiment of an adapter with an internal snap ring or ridge on one end for connecting to an additional embodiment of my hygienic dispenser with a base with an external groove for connecting instead of threads for connecting and the other end of the adapter with an internal groove for connecting to a toothpaste container with a tubular spout that has an external snap ring or ridge for connection.

FIG. 16 shows how an internal snap ring or ridge 54 in the adapter connects to an external snap groove 55 on the base of the dispenser. Also shown on the other end of the adapter is an internal snap groove 56 which mates with an external snap ring or ridge 57 of a tubular spout of a toothpaste container.

Figure 17:
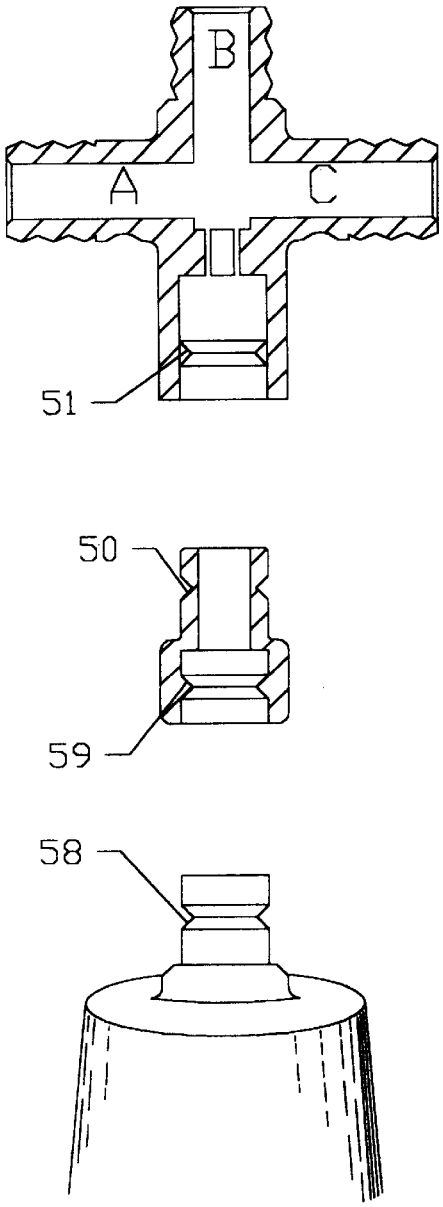
FIG. 17 shows a front sectional view of an additional embodiment of an adapter with an external groove on one end for connecting to an additional embodiment of my hygienic dispenser with a base with an internal flange for connecting instead of threads for connecting and the other end of the adapter an internal flange for connecting to a toothpaste container with a tubular spout that has an external groove for connecting.

FIG. 17 shows a sectional view of an adapter and a dispenser illustrated in FIG. 1B except the dispenser has an internal flange 51 instead of internal threads for connection. The adapter has an external groove 50 which mates with internal flange 51 of the dispenser. Also shown is a toothpaste container with a tubular spout that has an external groove 58 for connection with an internal flange 59 of the adapter.

Operation—FIGS. 12, 15 (Front Interior View)

These two adapters join the hygienic dispenser to the toothpaste container by grooves, ridges or flanges, and threads. First the adapter is connected to the dispenser by pushing the base of the dispenser and the grooved or ridged end of the adapter together. The threaded end of the adapter is then threaded onto the toothpaste tip (not shown) by turning the two together.

To disconnect one untwists the container from the adapter and pulls the adapter and dispenser apart.

Operation—FIGS. 13, 14, 16, 17 (Front Interior View)

These four adapters join the hygienic dispenser to the toothpaste container by grooves, ridges or flanges. First the adapter is connected to the dispenser by pushing the base of the dispenser and the grooved or ridged end of the adapter together. The adapter is joined to the toothpaste container by pushing the adapter and the tubular spout of the toothpaste container together.

The dispensers and the adapters are disconnected by pulling them apart. Likewise, the adapters and the toothpaste containers are separated by pulling them apart.

Figure 18:
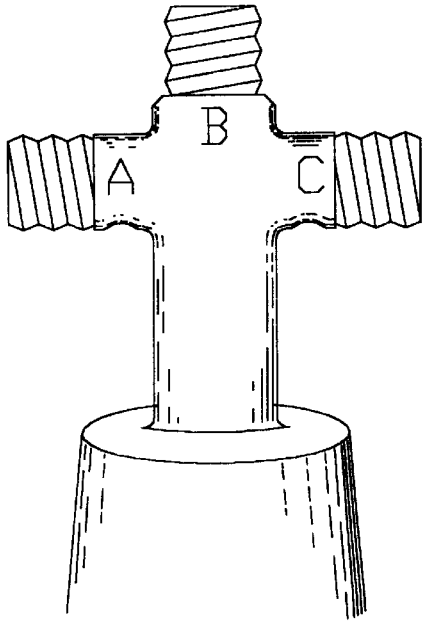
FIG. 18 shows an exterior view of an additional embodiment of a toothpaste container and my hygienic dispenser with three tubular spouts and caps manufactured as one unit.
Figure 19:
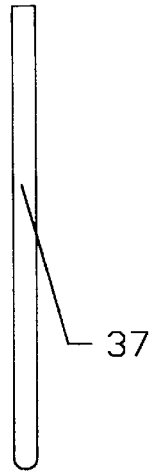
FIG. 19 shows a front view of a prior-art push rod.

Description—FIGS. 18, 19 (External Views)

FIG. 18 shows a front exterior view of an embodiment of a toothpaste container and a hygienic dispenser with three tubular spouts manufactured as one unit.

FIG. 19 shows a front view of a push rod 37 used to remove the ball and spring from the dispenser.

Operation—FIGS. 18, 19

The operation of FIG. 18 and FIG. 19 are explained in operation FIG. 1 and FIG. 2.

Conclusions, Ramifications, and Scope

It can be seen from the above that my dispenser has many unique characteristics and advantages.

It provides a dispenser with a few tubular spouts that is expandable to several tubular spouts by connecting two or more dispensers together into one unit.

It permits the use of one container of toothpaste when two or more dispensers are joined together in one unit and attached to a single tube.

It permits the user to install a ball and spring in the dispenser, creating a one-way check-valve, thus preventing the contents of the container from being contaminated.

It provides a dispenser with tubular spouts and caps that are permanently marked by indicia and can be color coordinated for personalized toothpaste dispensing.

It provides a dispenser with tubular spouts with notches and grooves that allow the user to hang the dispenser with the container of toothpaste hanging below it.

It provides a dispenser with a base having a means for connection to the tip of a toothpaste container or to an adapter that connects to a toothpaste container or to a tubular spout of another dispenser.

It should be understood by those skilled in the art that numerous modifications, substitutions, or variations of this dispenser are possible in light of the above teachings. For example, a flange or an other mechanism can be used instead of threads for connecting several dispensers together or for connecting a dispenser to a toothpaste container or an adapter. The dispenser and adapter could have both an internal and an external means of connection at the same time. There are certain obvious limitations to the overall size of a combined unit when combining many dispensers together. Likewise additional pressure is required to push the paste a farther distance. Also the dispenser could be in the form of a cylinder or other geometric shape. The dispenser can be manufactured in the shape of a cross, a "Y", a "T", etc. The dispenser and toothpaste container can even be manufactured as one unit and the use of the check-valve is optional. In lieu of the use for toothpaste, the dispenser can be used to dispense food pastes, glues, silicones, caulks, salves, etc.

Thus, the extent of this invention should be determined by the appended claims and their legal equivalents, rather than by the examples given.

What is claimed is:

1. A hygienic paste dispenser, comprising:

(a) a main body member having a hollow interior passageway that defines, provides, and expands the flow of paste-like material through said passageway, (b) said main body member having a cylindrical shape with a base and a plurality of tubular spouts, said base having a means for connection to a container of said paste-like material, and said base having a means for connection to said tubular spouts of another of said hygienic paste dispenser, and said tubular spouts of said main body member each having a means for connection to a cap, and said tubular spouts of said main body member each having a means for connection to said base of another of said hygienic paste dispenser, (c) said tubular spouts each having a hollow interior communicating with said hollow interior passageway of said main body member so that paste can be dispensed from a container of paste-like material through said main body member and then selectively dispensed from one of said tubular spouts, each of said tubular spouts bearing a unique permanent indicium, (d) said tubular spouts each having a removable cap bearing a matching unique permanent indicium as the respective tubular spout said cap fits, (e) whereby when said hygienic paste dispenser is connected to said container of paste-like material or said hygienic paste dispenser is connected to another said hygienic paste dispenser or dispensers first and then connected to said container of paste-like material and one of said caps is removed, and pressure is applied to said paste-like material in said container, said paste-like material will flow through said passageway of said main body member and said tubular spout and out of the spout from which said cap has been removed.

2. The hygienic dispenser of claim 1 wherein said base has a means for connecting to an adapter with a hollow passageway that can in turn connect to a plurality of types of container tips and sizes.

3. The hygienic dispenser of claim 2 wherein said adapter is adapted to include a means for preventing said paste-like material from flowing in more than one direction.

4. The hygienic dispenser of claim 1 wherein said base is threaded internally.

5. The hygienic dispenser of claim 4 further including an adapter or adapters that can adapt to a plurality of types of said container tips and sizes, said base of said hygienic dispenser being threaded so as to mate with a male threaded end of said adapter or said adapters.

6. The hygienic dispenser of claim 5 further including an adapter that is threaded so as to be able to mate with a male threaded tip of said container of paste-like material, said base of said hygienic dispenser being threaded so as to mate with said male threaded end of said adapter.

7. The hygienic dispenser of claim 5 further including an adapter that is threaded so as to be able to mate with a female threaded tip of said container of paste-like material, said base of said hygienic dispenser being threaded so as to mate with said male threaded end of said adapter.

8. The hygienic dispenser of claim 5 further including an adapter that has an internal groove for connecting to said container of paste-like material with an external flange, said base of said hygienic dispenser being threaded so as to mate with said male threaded end of said adapter.

9. The hygienic dispenser of claim 5 further including an adapter that has an external flange for connecting to said container of paste-like material with an internal groove, said base of said hygienic dispenser being threaded so as to mate with said male threaded end of said adapter.

10. The hygienic dispenser of claim 1 wherein said base is externally threaded.

11. The hygienic dispenser of claim 10 further including an adapter or adapters that can adapt to a plurality of types of container tips and sizes, said base of said hygienic dispenser being threaded into a female threaded end of said adapter or adapters.

12. The hygienic dispenser of claim 11 further including an adapter that is threaded so as to be able to mate with a male threaded tip of said container of paste-like material, said base of said hygienic dispenser being threaded into said female threaded end of said adapter.

13. The hygienic dispenser of claim 11 further including an adapter that is threaded so as to be able to mate with a female threaded tip of said container of paste-like material, said base of said hygienic dispenser being threaded into said female threaded end of said adapter.

14. The hygienic dispenser of claim 11 further including an adapter that has an internal groove for connecting to said container of paste-like material with an external flange, said base of said hygienic dispenser being threaded into said female threaded end of said adapter.

15. The hygienic dispenser of claim 11 further including an adapter that has an external flange for connecting to said container of paste-like material with an internal groove, said base of said hygienic dispenser being threaded into said female threaded end of said adapter.

16. The hygienic dispenser of claim 1 wherein said base has an internal groove for connecting.

17. The hygienic dispenser of claim 16 further including an adapter or adapters that can adapt to a plurality of types of container tips and sizes, said base of said hygienic dispenser being connected to an external flanged end of said adapter or adapters.

18. The hygienic dispenser of claim 17 further including an adapter that is threaded so as to be able to mate with a male threaded tip of said container of paste-like material, said base of said hygienic dispenser being connected to said external flanged end of said adapter.

19. The hygienic dispenser of claim 17 further including an adapter that is threaded so as to be able to mate with a female threaded tip of said container of paste-like material, said base of said hygienic dispenser being connected to said external flanged end of said adapter.

20. The hygienic dispenser of claim 17 further including an adapter that has an internal groove for connecting to said container of paste-like material with an external flange, said base of said hygienic dispenser being connected to said external flanged end of said adapter.

21. The hygienic dispenser of claim 17 further including an adapter that has an external flange for connecting to said container of paste-like material with an internal groove, said base of said hygienic dispenser being connected to said external flanged end of said adapter.

22. The hygienic dispenser of claim 1 wherein said base has an external flange for connecting.

23. The hygienic dispenser of claim 22 further including an adapter or adapters that can adapt to a plurality of types of container tips and sizes, said base of said hygienic dispenser being connected to an internal groove of said adapter or adapters.

24. The hygienic dispenser of claim 23 further including an adapter that is threaded so as to be able to mate with a male threaded tip of said container of paste-like material, said base of said hygienic dispenser being connected to said internal groove of said adapter.

25. The hygienic dispenser of claim 23 further including an adapter that is threaded so as to be able to mate with a female threaded tip of said container of paste-like material, said base of said hygienic dispenser being connected to said internal groove of said adapter.

26. The hygienic dispenser of claim 23 further including an adapter that has an internal groove for connecting to said container of paste-like material with an external flange, said base of said hygienic dispenser being connected to said internal groove of said adapter.

27. The hygienic dispenser of claim 23 further including an adapter that has an external flange for connecting to said container of paste-like material with an internal groove, said base of said hygienic dispenser being connected to said internal groove of said adapter.

28. The hygienic dispenser of claim 1 wherein said tubular spouts have different lengths and said tubular spout ends have different size openings.

29. The hygienic dispenser of claim 1 wherein said tubular spouts are color-coded so as to be differentiated by color.

30. The hygienic dispenser of claim 1 further including a plurality of caps which are marked with the same color-coding as the respective tubular spout said cap matches.

31. The hygienic dispenser of claim 1 wherein said hygienic dispenser is made of a washable material.

32. The hygienic dispenser of claim 1 wherein said base is adapted to be permanently affixed to said container of paste-like material so that said dispenser and said container are one unit.

33. The hygienic dispenser of claim 1 wherein said main body member has a removable check-valve.

34. The hygienic dispenser of claim 1 further including a holding means for hanging a hygienic paste dispenser, comprising:

(a) at least one of said tubular spouts being connected at an angle to said main body, (b) said caps, when installed on said respective spouts connected at an angle to said main body, create notches, bound on three sides by said main body member, said tubular spout, and an edge or an end of said cap, for holding, (c) whereby said created notches are provided to hold said hygienic paste dispenser in a hanging method.

35. The hygienic dispenser of claim 34 wherein at least one of said tubular spouts being connected at an angle to said main body also has a groove to aid in holding.

36. A valve means for controlling the flow of a paste-like material in one direction in a hygienic paste dispenser, comprising:

(a) a main body member having a hollow interior passageway, an inlet base, and discharge tubular spouts for conveying said paste-like material of a paste container from said inlet base through said discharge tubular spouts, (b) a plurality of ridges and grooves on an interior wall of said hollow passageway of said main body member, (c) a ball that can be installed in a chamber in said hollow passageway in said base of said main body member for controlling the flow of said paste-like material, (d) a spring that can be installed in a chamber in said hollow passageway in said base of said main body member for controlling the flow of said paste-like material, (e) said chamber in said hollow passageway of said base of said main body member being sized to contain said paste-like material, said ball, and said spring, (f) a push rod for installing and removing said ball and said spring from said main body member, (g) a container of said paste-like material, and an adapter;

(h) whereby when said spring and said ball are inserted in said base of said hygienic dispenser or when said ball is inserted in said base of said hygienic dispenser and then connected to said container of paste-like material, the flow of paste is controlled in one direction by said valve means that automatically opens when pressure is applied to said paste and automatically closes when said pressure on said paste is released, thereby preventing said paste from returning to said container and contaminating the contents.

37. The valve means of claim 36 wherein a main body member having a hollow interior passageway, an inlet base, and discharge tubular spouts uses a pushing rod or cleaning device for installing or removing said ball, said spring, and said paste from said main body member.

38. The valve means of claim 36 wherein said base has a means for connecting to a container of said paste-like material.

39. The valve means of claim 36 wherein said base has a means for connecting to an adapter with a hollow passageway that can in turn connect to a plurality of types of container tips and sizes.

40. The valve means of claim 39 wherein said adapter is adapted to include a means for preventing said paste-like material from flowing in more than one direction.

* * * * *